US005108545A

United States Patent [19]

Marumo et al.

[11] Patent Number: 5,108,545

[45] Date of Patent: Apr. 28, 1992

[54] METHOD FOR MAKING PAPER SUPPORT

[75] Inventors: Kenji Marumo; Akihiro Ogawa, both of Tokyo; Shinsuke Ikemagi, Hachinohe, all of Japan

[73] Assignee: Mitsubishi Paper Mills Limited, Tokyo, Japan

[21] Appl. No.: 495,135

[22] Filed: Mar. 19, 1990

Related U.S. Application Data

[63] Continuation-in-part of Ser. No. 203,619, May 23, 1988, abandoned, which is a continuation of Ser. No. 871,774, Jun. 9, 1986, abandoned.

[30] Foreign Application Priority Data

Jun. 10, 1985 [JP] Japan ..... 60-126796

[51] Int. Cl.[5] ..... D21H 1/34

[52] U.S. Cl. ..... 162/135; 162/164.3; 162/179; 162/203; 162/355; 427/209; 427/391

[58] Field of Search ..... 162/355, 203, 356, 135, 162/164.3, 179, 352x; 427/209, 439, 324, 326, 391, 395

[56] References Cited

U.S. PATENT DOCUMENTS 4,420,370 12/1983 Saad ..... 162/352 X
4,648,943 3/1987 Malashenko et al. ..... 162/301 X
4,659,430 4/1987 Tamagawa et al. ..... 162/135

FOREIGN PATENT DOCUMENTS 2003952 3/1979 United Kingdom .

*Primary Examiner*—David A. Simmons
*Assistant Examiner*—Thi Dang
*Attorney, Agent, or Firm*—Cushman, Darby & Cushman

[57] ABSTRACT

Disclosed is a method for making a paper support for photographic paper by a Fourdrinier paper machine of the twin-wire type provided with a lower wire on which a wet web is formed and an endless upper wire facing said lower wire with the wet web between them wherein the upper wire comes in contact with the wet web after the latter has travelled a distance of 5 to 12 m from the point where the paper stock had been fed to the lower wire which is preferably shaked in a horizontal direction and the rate of drainage through the upper wire to the sum of drainages through the lower wire and the upper wire is adjusted to 15 to 50% to give a smooth surface on which a photographic emulsion layer is to be formed.

22 Claims, 3 Drawing Sheets

METHOD FOR MAKING PAPER SUPPORT

RELATED APPLICATIONS

This is a continuation-in-part of U.S. patent application Ser. No. 07/203,619 filed May 23, 1988 now abandoned, which is a continuation of Ser. No. 06/871,774, filed Jun. 9, 1986, now abandoned.

BACKGROUND OF THE INVENTION

This invention relates to a method of making a paper support for photographic paper. More particularly, it relates to a method of making a paper support for photographic paper, which is excellent in uniform receptivity to emulsion coating and is free of ridge-like irregularities in the machine direction (hereinafter referred to briefly as surface irregularity) and free of separation of the paper support into two layers.

Photographic paper for color print or black and white print is generally processed in liquid media. As a consequence, a paper support of the photographic paper has been made of base paper having a sufficient wet strength. Baryta paper, which was widely used, is a paper support generally made by coating a wet-strength base paper with a coating composition comprising gelatin as binder and, dispersed therein, barium sulfate, an inorganic white pigment, and then drying. In recent years, with speed-up of the photographic processing, there has been chiefly used a paper support of resin-coated paper made by coating a base paper on both sides with a water-resistant resin.

The base paper for various paper supports is generally made by means of a Fourdrinier paper machine in which a web is formed by feeding a paper stock onto a travelling endless long wire cloth. The paper making speed has become higher to increase the productivity and various efforts have been made to keep the paper quality from decline caused by the high-speed paper making. Although not yet actually used in making photographic paper, a paper machine of the twin-wire type is used in making some of the newsprint and general printing paper. For example, according to U.K. Patent Application GB 2003952 A, a paper web is formed by dewatering a stock upwardly and downwardly simultaneously by using a top upwardly dewatering unit in conjunction with traditional downwards drainage. But, since a paper support for photographic paper is not aimed at by this U.K. patent application, a paper web with uniform distribution of fines and ash (clay) therein and a minimum two-sidedness is formed by adjusting the location of the top unit, for example, from 1 to 3 meters from a slice for feeding the paper stock. This U.K. patent application is quite silent on how to improve the smoothness of the surface of web on which a photographic emulsion layer is to be formed. When such a paper web is used for a paper support for photographic paper, there arise various problems, since there are many severe quality requirements in the production of photographic paper.

Improvements in productivity, for instance, the speed of coating the emulsion becomes higher and in making photographic paper for color print the conventional method of successively applying the required number of single coating layers is being superseded by the method of simultaneous coating of two or more emulsion layers or even simultaneous coating of total layer consisting of two or more emulsion layers. For such purposes, the support, not to speak of the emulsion, should meet severe quality requirements. In particular, the simultaneous total layer coating procedure suffers from the phenomenon called "shear in emulsion layers", that is, failure in uniformity of coating layers resulting from a delicate change in the thickness of a portion of emulsion layer, which leads to mottled surface of a color print, detracting much from the commercial value of the photographic paper.

Although the exact reasons for the phenomenon of shear in emulsion layers are yet to be elucidated, it is known that with the increase in speed of coating the emulsion, the shear in emulsion layers becomes more pronounced. The shear in emulsion layers is affected to some degree by the surface texture of the photographic paper, such as silk-finish, fine grained, matt, or glossy surface. In every case, however, the shear in emulsion layers tends to occur more easily with the increase in coating speed of the emulsion.

The factors of a support which affect the shear in emulsion layers include surface irregularities of the base paper used in making the support. The shear in emulsion layers decreases with the decrease in the degree of surface irregularities of the base paper. For instance, the phenomenon of shear in emulsion layers can be suppressed to a certain extent by calendering the base paper to increase the bulk density and, hence, to improve the surface irregularities. However, such a treatment is not sufficiently effective and, in addition, is not economical if it is necessary to increase the basis weight of base paper to retain required thickness of the support. If the web forming speed of the paper machine is increased, the resulting base paper exhibits increased surface irregularities, resulting in increased shear in emulsion layers. U.S. Pat. No. 4,582,785 to Woodward et al discloses polyolefin coated photographic base papers wherein a special stabilizer is used to prevent cracking in the image-containing layer, or even both the image-containing and the resin-containing layers. But Woodward et al have no inventive idea of having excellent surface characteristics (few surface irregularities) which allow high-speed coating of emulsions without exhibiting shear in emulsion layers.

SUMMARY OF THE INVENTION

It is an object of the present invention to provide a method for making a paper support for photographic paper support having excellent surface characteristics (few surface irregularities and a smooth surface particularly at the side of forming a photographic emulsion layer), said paper support being free from the shear in emulsion layers even when the paper support is made by a high-speed paper machine or when the emulsions are coated at a high speed on the paper support, and free of wire marks of an upper wire for drainage on a wet web surface and of separation of the paper support into two layers.

The present invention provides a method for making a paper support for a photographic paper employing a Fourdrinier paper machine of the twin-wire type and having a lower wire and an endless upper wire facing said lower wire, said method comprising feeding paper stock having a solid content of 0.5 to 2% by weight to said lower wiring for forming a wet web on said lower wire, contacting the upper wire with the wet web after the wet web has travelled a distance of 5 to 12 meters from the point where the paper stock has been fed to the lower wire, adjusting the rate of drainage through the upper wire so that it is 15 to 50% of the sum of drainages through the lower wire and the upper wire to give a base paper, and applying a water resistant resin to both surfaces of the base, paper whereby the resulting paper support for a photographic paper prevents undesirable surface irregularities and causes no shear in emulsion layers of a photographic paper made from said paper support.

DESCRIPTION OF THE PREFERRED EMBODIMENTS

The method of making a paper support for use in photography according to this invention comprises making a base paper for the support by using a Fourdrinier paper machine of the twin-wire type provided with a lower wire on which a wet web is formed and an endless upper wire facing said lower wire with said wet web between them, a paper stock to be supplied having a solid content (or concentration) of 0.5 to 2.0% by weight and the lower wire preferably being shaked at the point where the paper stock has been fed, the upper wire coming in contact with the wet web after the wet web has travelled a distance of 5 to 12 m from the point where the paper stock had been fed to the lower wire, and adjusting the rate of drainage through the upper wire to the sum of the drainages through the lower wire and the upper wire (hereinafter referred to as upper drainage rate) to 15 to 50% to give a base paper, followed by application of a water resistant resin to both surfaces of the base paper.

Figure 4:
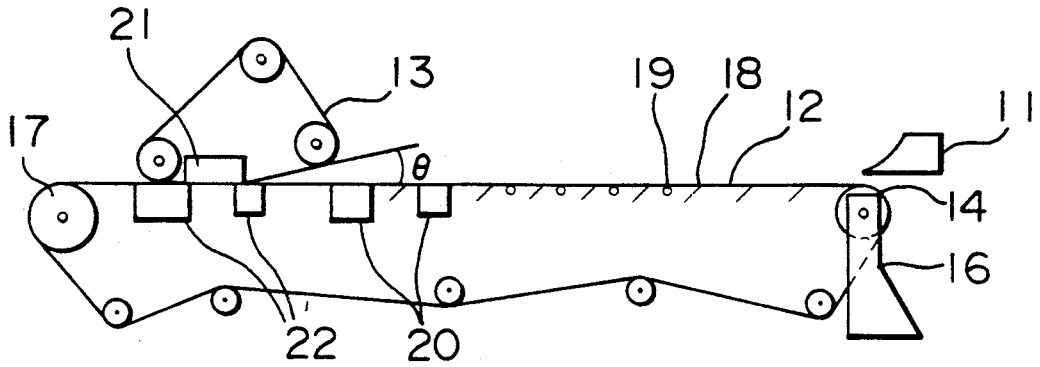
FIG. 4 is a side view of one example of a Fourdrinier paper machine of the twin-wire type used in the present invention.
Figure 5:
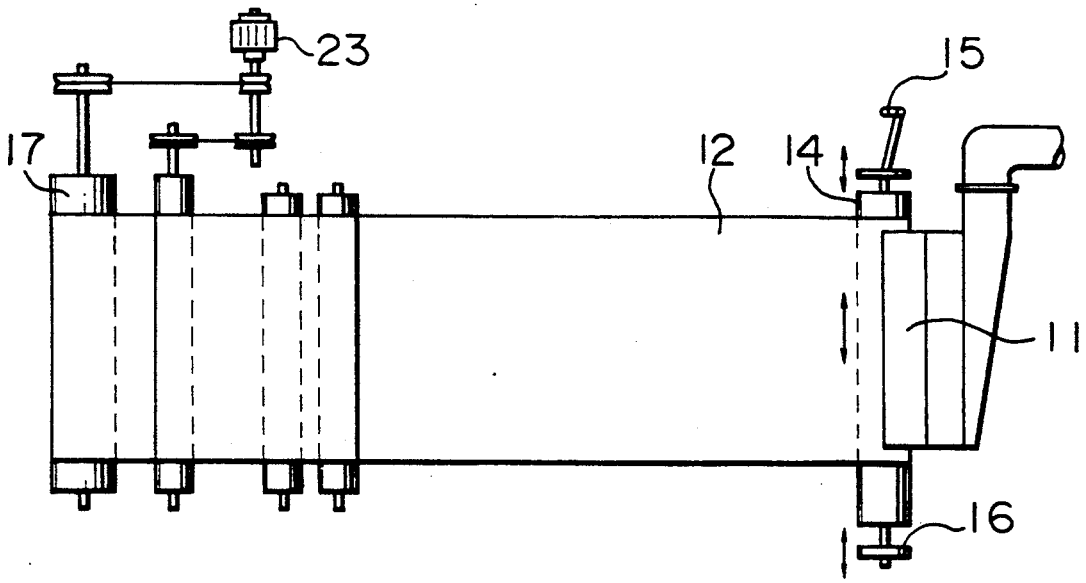
FIG. 5 is a plane view of the paper machine of FIG. 4.

The method of the present invention is explained more in detail referring to FIGS. 4 and 5.

A paper stock having a solid content of 0.5 to 2% by weight, preferably 0.5 to 1.2% by weight, in the form of a slurry poured out from a head box (or slice) 11 on a lower wire 12 travels freely under an open state at the upside and dewatered to a certain concentration of the slurry, while passing on a foil 18, a table roll 19, and suction boxes 20, these being placed under the lower wire 12, to an entrance of an endless upper wire 13. Then, the web having a solid content of 1.2 to 4% by weight, preferably 1.3 to 3.5% by weight, is placed between the lower wire 12 and the upper wire 13 (before contact) gently so as to keep both uniformity in the thickness direction and surface smoothness which have been formed gradually until this time to effectively dewater the web using a suction box 21 of the upper wire and a suction box 22 of the lower wire. Numeral 23 denotes a line driving device. The resulting web at the outlet (after the contact) of the upper wire 13 has a solid content of 8 to 20%, preferably 10 to 16%, by weight.

When the concentration (solid content) of the paper stock fed from the slice 11 is lower than 0.5% by weight, handling of the paper stock becomes difficult due to the presence of much water, whereas when the concentration is more than 2% by weight, the smooth surface required in the present invention cannot be formed. Further the lower wire is undesirably lowered in shaking effect, if the lower wire is shaked at the feeding point of the paper stock.

In order to increase the effects of the present invention, it is preferable to shake the lower wire at the point where the paper stock is fed at 50 to 500 times per minute, more preferably 100 to 300 times per minute, with an amplitude of 3 to 25 mm, more preferably 5 to 15 mm, in the direction perpendicular to the running direction of the lower wire.

By preferably shaking the lower wire 12 horizontally by a breast roll 14 in the direction perpendicular to the running direction of the web, there is formed preferable uniformity in the thickness direction and surface smoothness in the web. The breast roll 14 is supported by a flexible supporting plate 16 made of a steel plate or a plastic composite material on its axis. The breast roll 14 or the flexible supporting plate 16 is shaked by a shaking means 15 such as a crank. The upper wire 13 is positioned relatively near a couch roll 17 and remarkably far from the shaking breast roll 14, the change of the width of the lower wire by the shaking movement is very small at the position of the upper wire 13, influence of the shaking movement to the quality of the web is negligible.

The shaking of the lower wire by the breast roll is conducted at 50 to 500 times, preferably 100 to 300 times, per minute with an amplitude of 3 to 25 mm, preferably 5 to 15 mm, in the direction perpendicular to the running direction of the lower wire. When the shaking time is less than 50 times/minute, the effect of shaking is undesirably low, while when the shaking time is more than 500 times/minute, good uniformity in the thickness direction and surface smoothness of the web is broken due to too vigorous movement of the lower wire.

The amplitude of the shaking is 3 to 25 mm, preferably 5 to 15 mm. When the amplitude is less than 3 mm, the effect of shaking is undesirably low, while when the amplitude is more than 25 mm, the paper stock on the edge portions of the lower wire is undesirably dropped from the lower wire.

The angle $\theta$ between the upper wire and the wet web on the lower wire at the entrance of the upper wire (before the contact of the upper wire and the wet web on the lower wire) is preferably 3° to 30°. When the angle is less than 3°, there is a tendency to destroy the web due to too narrow entrance. On the other hand, when the angle is larger than 30°, there is a tendency to rapidly narrow the clearance between the upper wire and the lower wire so as to destroy the desirable uniform formation of the wet web at the entrance of the upper wire.

The upper wire should be positioned so that it may come into contact with the wet web after the wet web has travelled a distance of 5 to 12 m, preferably 7 to 11 m from the point of feeding the paper stock. If the distance is below 5 m, the power stock containing a large amount of water comes into contact with the upper wire which exerts an excessive pressure to interfere with uniform formation of the web in the direction of thickness, resulting in surface irregularities of the paper sheet; and, moreover, the wet web tends to separate into two layers as the web is drained in both directions, resulting in a structure which absorbs a large amount of processing solutions during the photographic processing, resulting in deterioration of commercial value. If the distance exceeds 12 m, the paper stock is drained to a large extent through the lower wire and the surface layer of the web becomes too dense to acquire desirable surface characteristics, resulting in a base paper not improved in the shear in emulsion layers.

The length of the upper wire contacting with the wet web on the lower wire for drainage is preferably 2.5 to 4 meters.

The upper drainage rate is preferably 15 to 50%, more preferably 20 to 40%. If the upper drainage rate is below 15%, uniform formation of the web in the direction of thickness is not achieved and the resulting base paper will show surface characteristics similar to those of the paper made by means of a conventional Fourdrinier machine, whereas if the upper drainage rate exceeds 50%, the web tends to acquire two-lamellar structure of upper and lower ones, resulting in a decline in delamination resistance, and tends to show a wire mark on the surface. The length of the portion of the upper wire with which the web contacts is preferably 2.5–4 m.

The velocity of paper making is preferably 200 m/min or more, and 500 m/min or less so as to obtain the effects of the present invention.

The surface characteristics of the base paper obtained as described above are not essentially changed by coating the both sides with a water-resistant resin.

The base paper used in the support according to this invention is principally made of a natural pulp. However, if necessary, the base paper may contain synthetic pulps or synthetic fibers. Although the paper support according to this invention is not specifically restricted in basis weight, yet it is preferable that the base paper has a basis weight of 50–300 g/m$^2$ and a bulk density of 0.8–1.20 g/cm$^3$, more preferably 0.90–1.06 g/cm$^3$. When the bulk density is lower than 0.8 g/cm$^3$, there is a tendency to increase the surface irregularity. On the other hand, when the bulk density is larger than 1.20 g/cm$^3$, there appear reliefs on an emulsion coating surface larger than the surface irregularity due to compression of base paper, which results in bringing about shift of photographic emulsion at the time of coating thereof.

The base paper for the paper support according to this invention, which comprises natural pulp as principal constituent, may contain dry strength agents, wet strength agents, fixing agents for the strength agents, electrolytes, pigments, pH regulating agents, dyes, fluorescent whiteners, various polymeric compounds, and other additives. The polymeric compounds and additives can be added to an aqueous slurry containing natural pulp as principal constituent or to a size used in press sizing, tub sizing, or spray sizing.

The paper support of this invention can be coated with a resin by common methods such as extrusion coating, solvent coating, and the like. In some cases, the coated resin can be cured by electron beam. A resin in film form can be applied by the method of dry lamination or wet lamination. The embossing can be performed by pressing coated or laminated paper sheet against an embossing roll. In the case of extrusion coating, an embossing roll is used as the cooling roll to carry out coating and embossing at the same time. The electron beam curing is performed in such a manner that while being pressed against an embossing roll, the resin-coated paper sheet is exposed to an electron beam.

The resins for coating are most generally polyethylenes, but any resins which have water resistance and do not have bad effects on the photographic emulsion such as other thermoplastic resins, thermosetting resins, electron beam curing resins, etc. may be used.

The resins may further contain titanium oxide, coloring agents, electroconducting agents, stabilizers, etc.

The resin-coated paper is generally subjected to corona treatment. If required for the purpose of use, the coated paper is further provided with a back coat on a side opposite to the photographic emulsion coating side and a subbing coat at the photographic emulsion coating side.

This invention is further illustrated in detail below with reference to Examples, in which all parts and percents are by weight, unless otherwise specified.

EXAMPLES 1 TO 4, COMPARATIVE EXAMPLES 1 AND 2

A blended pulp comprising 50 parts by weight of LBKP (hardwood bleached kraft pulp) and 50 parts by weight of LBSP (hardwood bleached sulfite pulp) was treated in a beater to a beating degree of 300 ml CSF (Canadian standard freeness). A paper stock was prepared by adding to the resulting pulp slurry 0.5% by weight (pulp basis) of an alkylketene dimer size, 2.0% by weight (pulp basis) of polyacrylamide, and 0.5% by weight (pulp basis) of polyamide-epichlorohydrin resin, both used as strength agents. The resulting paper stock having a solid content of 1.0% was placed on a lower wire of a Fourdrinier machine running at a velocity of 200 m/minute. The solid content of the paper stock was adjusted so as to become 1.4% before contact of the upper wire with the lower wire and 8% after contact of the upper wire with the lower wire. The position of the upper wire was at a distance of 4, 5, 7, 11, 12, or 13 m. The length of the upper wire contacting with the wet web on the lower wire was 3 m and the angle ($\theta$) between the upper wire and the lower wire just before contact (at the inlet) was 20°. The wet web was formed at an upper drainage rate of 20% and then dried. Before complete drying, the web was coated with a solution containing a modified polyvinyl alcohol in a sizing tub to increase the surface strength, and then dried. The degree of drying and the degree of calendering were adjusted so that there may be obtained a base paper of 8% in moisture content, 170 g/cm$^2$ in basis weight, and 1.04 in bulk density.

The base paper was then treated on one side with corona discharge and coated, by means of an melt extrusion coater, with a molten (at 320° C.) mixture comprising 50 parts by weight of a high-density polyethylene (0.96 in density and 7 in melt index) and 50 parts by weight of a low-density polyethylene (0.92 in density and 5 in melt index) to a thickness of 30 $\mu$m. The opposite side of the base paper was subjected to corona discharge treatment and coated with a molten (at 320° C.) low-density polyethylene containing 9% of anatase titanium oxide to a thickness of 25 $\mu$ (the original unpigmented polyethylene was 0.92 in density and 5 in melt index). The resin-coated surfaces were fine mattfinished by means of a cooling roll having a central line mean roughness of 1 $\mu$.

The resin-coated support was coated with emulsions for color print by the method of simultaneous coating of total layer. The coating speed was varied until the maximum tolerable shear in emulsion layers had been observed. The test results were as shown in Table 1.

TABLE 1

| Sample | Speed of wire (m/min) | Position of upper wire (m) | Upper drainage rate (%) | Rating of surface irregularity | Shear in emulsion layers (m/min) | Delamination resistance (g) |
|---|---|---|---|---|---|---|
| Comparative Example 1 | 200 | 4 | 20 | 4 | 130 | 64 |
| Example 1 | " | 5 | " | 3 | 180 | 90 |
| Example 2 | " | 7 | " | 2 | 200 ↑ | 105 |
| Example 3 | " | 11 | " | 2 | 200 ↑ | 110 |
| Example 4 | " | 12 | " | 3 | 180 | 110 |
| Comparative Example 2 | " | 13 | " | 4 | 120 | 112 |

Note:

The maximum coating speed of the coater was 200 m/min. Therefore, 200 ↑ means that entirely no shear was observed at the coating speed of 200 m/min.

The surface irregularity was evaluated by visual inspection of the degree of ridge-like irregularity in the machine direction and expressed according to the numerical rating system. A smaller rating number means better smoothness.

EXAMPLES 5 TO 8, COMPARATIVE EXAMPLES 3 AND 4

Wet webs were formed by using the same paper stock as used in Examples 1 to 4 and Comparative Examples 1 and 2, at varied upper drainage rates of 14, 15, 20, 40, 50 and 53%, the position of the upper wire having been fixed at a distance of 9 m. As described in the foregoing Examples and Comparative Examples, each web was coated with the modified polyvinyl alcohol and dried to obtain a base paper of 8.2% in moisture content, 170 g/m$^2$ in basis weight, and 0.92 in bulk density.

In the same manner as in the foregoing Examples 1–4 and Comparative Examples 1 and 2, each base paper was coated with a resin and overcoated with emulsions for color print by the method of simultaneous total layer coating. The coated photographic paper was tested for the maximum coating speed to produce maximum tolerable shear in emulsion layers. The test results were as shown in Table 2.

Figure 1:
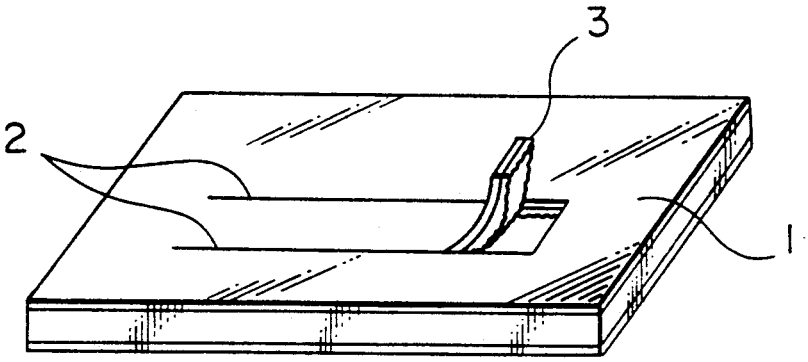
FIG. 1 is an oblique view of a sample whose delamination resistance is to be measured.
Figure 2:
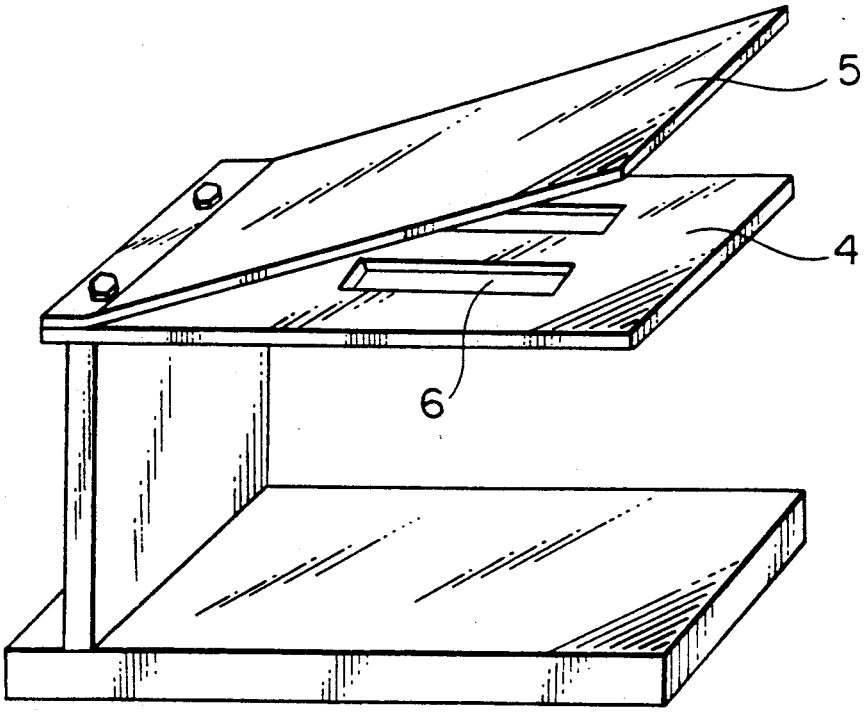
FIG. 2 is an oblique view of an apparatus for measuring the delamination resistance.
Figure 3:
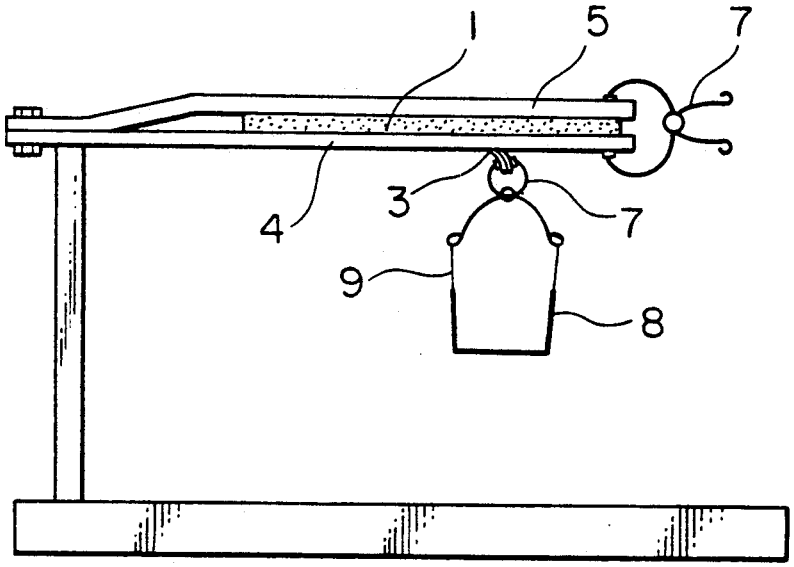
FIG. 3 is an outline of the apparatus for measuring the delamination resistance on which the sample is mounted.

As shown in FIG. 1, a sample (1) of two-side resin-coated paper was cut from the back side into the middle layer by means of a twin-blade cutter of the parallel type, the blades being 7 mm apart, thereby to make parallel cuts (2) 7 mm apart and with a length of 9 cm. A portion of this cut portion was then peeled back. A portion of this peeled back piece (3) was connected through the opening (6), of a size 1×10 cm, of the holding plate (4) of a testing apparatus as shown in FIG. 2 to a water receiver (8) by means of a clip (7) and a piece of thread (9) as shown in FIG. 3. Water was added by fixed increments into the receiver (8) until the delamination of the test piece had taken place. The total weight, in g, of water and receiver was assumed to be delamination resistance.

As is apparent from the results shown in Tables 1 and 2, the photographic paper support obtained according to this invention exhibits little surface irregularity and practically no shear in emulsion layers even when emulsions were applied at a high coating speed by the method of simultaneous total layercoating. As a consequence, the productivity in the step of emulsion coating can be greatly improved.

EXAMPLE 9

The process of Example 4 was repeated except for changing the solid content in the paper stock at the feeding, and before and after the contact of the upper and lower wires as listed in Table 3.

TABLE 2

| Sample | Speed of wire (m/min) | Position of upper wire (m) | Upper drainage rate (%) | Rating of surface irregularity | Shear in emulsion layers (m/min) | Delamination resistance (g) |
|---|---|---|---|---|---|---|
| Comparative Example 3 | 200 | 9 | 53 | 4 | 140 | 55 |
| Example 5 | " | " | 50 | 3 | 180 | 75 |
| Example 6 | " | " | 40 | 2 | 200 ↑ | 103 |
| Example 7 | " | " | 20 | 2 | 200 ↑ | 115 |
| Example 8 | " | " | 15 | 3 | 170 | 115 |
| Comparative Example 4 | " | " | 14 | 4 | 130 | 115 |

The delamination resistance in Tables 1 and 2 were tested in the following manner. The lower allowable limit was 70 g.

The results are as shown in Table 3.

TABLE 3

| Run No. | Solid content in paper stock (%) At the time of feeding | Before contact with upper wire | After contact with lower wire | Rating of surface irregularity | Shear in emulsion layers (m/min) | Delamination Resistance |
|---|---|---|---|---|---|---|
| 1 | 0.2 | 1.0 | 7 | ≦4 | ≦100 | 104 |
| 2 | | 1.5 | 8 | ≦4 | ≦100 | 110 |
| 3 | | 3.5 | 16 | ≦4 | ≦100 | 109 |
| 4 | 0.5 | 1.2 | 8 | 3 | 170 | 112 |
| 5 | | 1.5 | 8 | 3 | 180 | 112 |
| 6 | | 1.7 | 10 | 2 | 191 | 112 |
| 7 | 1.0 | 1.4 | 9 | 3 | 180 | 113 |
| 8 | 1.41 | 1.7 | 10 | 2 | 190 | 114 |
| 9 | | 2 | 12 | 2 | ≧200 | 114 |
| 10 | | 3.5 | 16 | 2 | 190 | 113 |
| 11 | 2 | 3.5 | 16 | 3 | 180 | 103 |
| 12 | | 4 | 20 | 3 | 165 | 102 |

TABLE 3-continued

| Run No. | Solid content in paper stock (%) At the time of feeding | Before contact with upper wire | After contact with lower wire | Rating of surface irregularity | Shear in emulsion layers (m/min) | Delamination Resistance |
|---|---|---|---|---|---|---|
| 13 | 2.4 | 3.5 | 16 | ≦4 | ≦100 | 98 |

EXAMPLE 10

The process of Example 4 was repeated except for shaking the lower wire at the point where the paper stock was fed as shown in Table 4.

The results are as shown in Table 4.

TABLE 4

| Run No. | Speed of wire (m/min) | Position of upper wire (m) | Upper drainage rate (%) | Shaking times (times/min) | Shaking amplitude (mm) | Rating of surface irregularity | Shear in emulsion layers (m/min) | Delamination resistance (g) |
|---|---|---|---|---|---|---|---|---|
| 1 | 200 | 12 | 20 | 50 | 25 | 3 | 188 | 115 |
| 2 | " | " | " | 100 | 20 | 2 | 195 | 118 |
| 3 | " | " | " | 180 | 10 | 1 | ≧200 | 122 |
| 4 | " | " | " | 150 | 15 | 1 | ≧200 | 120 |
| 5 | " | " | " | 0 | 0 | 3 | 180 | 113 |
| 6 | " | " | " | 300 | 5 | 2 | 193 | 117 |
| 7 | " | " | " | 550 | 5 | 4 | 150 | 110 |
| 8 | " | " | " | 500 | 3 | 3 | 185 | 115 |

What is claimed is:

1. A method for making a paper support for a photographic paper employing a Fourdrinier paper machine of the twin-wire type and having a lower wire and an endless upper wire facing said lower wire, said method comprising feeding paper stock having a solid content of 0.5 to 2% by weight to said lower wiring for forming a wet web on said lower wire, contacting the upper wire with the wet web after the wet web has travelled a distance of 5 to 12 meters from the point where the paper stock has been fed to the lower wire, adjusting the rate of drainage through the upper wire so that it is 15 to 50% of the sum of drainages through the lower wire and the upper wire to give a base paper and applying a water resistant resin to both surfaces of the base paper, whereby the resulting paper support for a photographic paper prevents undesirable surface irregularities and causes no shear in emulsion layers of a photographic paper made from said paper support, wherein the solid content in the wet web before the contact with the upper wire is 1.2 to 4% by weight and the solid content in the wet web after the contact with the upper wire is 8 to 20% by weight.

2. A method according to claim 1, which further comprises applying a back coat on a side opposite to a photographic emulsion coating side and a subbing coat on a photographic emulsion coating side.

3. A method according to claim 1, wherein the water resistant resin is polyethylene.

4. A method for making a paper support for photographic paper according to claim 1, wherein the upper wire comes in contact with the wet web after the latter has travelled a distance of 7 to 11 m from the point where the paper stock had been fed to the lower wire.

5. A method for making a paper support for photographic paper according to claim 1, wherein the rate of the drainage is 20–40%.

6. A method for making a paper support for photographic paper according to claim 1, wherein the length of the portion of the upper wire with which the web contacts is 2.5 to 4 m.

7. A method for making a paper support for photographic paper according to claim 1, wherein the length of the portion of the upper wire with which the web contacts is 2.5 to 4 m.

8. A method according to claim 1, wherein the angle of the upper wire to the wet web on the lower wire at the point of contact is 3° to 30°.

9. A method according to claim 1, wherein the length of the upper wire contacting with the wet web on the lower wire is 2.5 to 4 meters.

10. A method according to claim 1, wherein the bulk density of the base paper is 0.8 to 1.20 g/cm$^3$.

11. A method for making a paper support for a photographic paper employing a Fourdrinier paper machine of the twin-wire type and having a lower wire and an endless upper wire facing said lower wire, said method comprising feeding paper stock having a solid content of 0.5 to 2% by weight to said lower wiring for forming a wet web on said lower wire which is shaked horizontally at the point where the paper stock is fed at 50 to 500 times per minute with an amplitude of 3 to 25 mm in the direction perpendicular to the running direction of the lower wire, contacting the upper wire with the wet web after the wet web has travelled a distance of 5 to 12 meters from the point where the paper stock has been fed to the lower wire, adjusting the rate of drainage through the upper wire so that it is 15 to 50% of the sum of drainages through the lower wire and the upper wire to give a base paper, and applying a water resistant resin to both surfaces of the base paper, whereby the resulting paper support for a photographic paper prevents undesirable surface irregularities and causes no shear in emulsion layers of a photographic paper made from said paper support.

12. A method according to claim 3, wherein the paper stock has a solid content of 0.5 to 1.2% by weight when fed to the lower wire.

13. A method according to claim 11, wherein the solid content in the wet web before the contact with the upper wire is 1.2 to 4% by weight and the solid content in the wet web after the contact with the upper wire is 8 to 20% by weight.

14. A method according to claim 11, wherein the lower wire is shaked at the point where the paper stock is fed at 100 to 300 times per minutes with an amplitude of 5 to 15 mm in the direction perpendicular to the running direction of the lower wire.

15. A method according to claim 11, which further comprises applying a back coat on a side opposite to a photographic emulsion coating side and a subbing coat on a photographic emulsion coating side.

16. A method according to claim 11, wherein the water resistant resin is polyethylene.

17. A method for making a paper support for photographic paper according to claim 11, wherein the upper wire comes in contact with the wet web after the latter has travelled a distance of 7 to 11 m from the point where the paper stock has been fed to the lower wire.

18. A method for making a paper support for photographic paper according to claim 11, wherein the rate of the drainage is 20–40%.

19. A method according to claim 11, wherein the angle of the upper wire to the wet web on the lower wire at the point of contact is 3° to 30°.

20. A method according to claim 3, wherein the length of the upper wire contacting with the wet web on the lower wire is 2.5 to 4 times.

21. A method according to claim 3, wherein the bulk density of the base paper is 0.8 to 1.20 g/cm$^3$.

22. A method for making a paper support for a photographic paper employing a Fourdrinier paper machine of the twin-wire type and having a lower wire and an endless upper wire facing said lower wire, said method comprising feeding paper stock to said lower wire forming a wet web on said lower wire which is shaked at the point where the paper stock has been feed at 50 to 500 times per minute with an amplitude of 3 to 25 mm in the direction perpendicular to the running direction of the lower wire, contacting the upper wire with the wet web after the wet web has travelled a distance of 5 to 12 meters from the point where the paper stock has been fed to the lower wire and adjusting the rate of drainage through the upper wire so that it is 15 to 50% of the sum of drainages through the lower wire and the upper wire applying a water resistant resin to both surfaces of the web, and applying an emulsion for color print to the resin-coated support, whereby the resulting paper support for a photographic paper prevents undesirable surface irregularities and causes no shear in emulsion layers of a photographic paper made from said paper support.

* * * * *

UNITED STATES PATENT AND TRADEMARK OFFICE

CERTIFICATE OF CORRECTION

PATENT NO. : 5,108,545

DATED : April 28, 1992

INVENTOR(S) : MARUMO, et al.

It is certified that error appears in the above-identified patent and that said Letters Patent is hereby corrected as shown below:

On the Title page

[75] Inventors:

Correct the spelling of the family name of the third-listed inventor to -- Shinsuke IKEGAMI --.

Signed and Sealed this

Twenty-ninth Day of March, 1994

*Attest:*

*Attesting Officer*

Bruce Lehman

BRUCE LEHMAN

*Commissioner of Patents and Trademarks*